US008514669B2

(12) United States Patent
Marechal et al.

(10) Patent No.: US 8,514,669 B2
(45) Date of Patent: Aug. 20, 2013

(54) STRIKE MECHANISM FOR A WATCH

(75) Inventors: Sylvain Marechal, Bos-D'Amont (FR); Jean-François Pesenti, Morbier (FR); Jérôme Favre, Les Bioux (CH); Nakis Karapatis, Premier (CH)

(73) Assignee: Montres Breguet SA, L'Abbaye (CH)

( * ) Notice: Subject to any disclaimer, the term of this patent is extended or adjusted under 35 U.S.C. 154(b) by 145 days.

(21) Appl. No.: 12/976,004

(22) Filed: Dec. 22, 2010

(65) Prior Publication Data

US 2011/0158058 A1 Jun. 30, 2011

(30) Foreign Application Priority Data

Dec. 24, 2009 (CH) ..... 2002/09

(51) Int. Cl.
*G04B 25/00* (2006.01)

(52) U.S. Cl.
USPC ..... 368/243; 368/273

(58) Field of Classification Search
USPC ..... 368/243, 244–246, 272–273
See application file for complete search history.

(56) References Cited

U.S. PATENT DOCUMENTS

| | | | | |
|---|---|---|---|---|
| 1,414,253 | A * | 4/1922 | Brunner | 368/273 |
| 1,518,317 | A * | 12/1924 | Favre-Bulle | 368/270 |
| 2,146,711 | A * | 2/1939 | Claves | 368/271 |
| 2,288,933 | A * | 7/1942 | Ager-Wick | 368/267 |
| 7,065,005 | B2 * | 6/2006 | Rochat | 368/72 |
| 2008/0008052 | A1 * | 1/2008 | Moteki | 368/260 |
| 2008/0192585 | A1 * | 8/2008 | Corthesy et al. | 368/268 |
| 2008/0273426 | A1 * | 11/2008 | Corthesy et al. | 368/262 |

FOREIGN PATENT DOCUMENTS

| | | |
|---|---|---|
| EP | 0 451 335 | 10/1991 |
| EP | 1 574 917 | 9/2005 |
| EP | 2 048 548 | 4/2009 |
| JP | 8-94771 | 4/1996 |

OTHER PUBLICATIONS

Search Report issued in corresponding Swiss application 02002/09, completed Apr. 23, 2010.
"Interrupted Pendulum, and Loop-De-Loop," at http://www.av8n.com/physics/loop-de-loop.htm (2006), downloaded Jan. 11, 2013 (five pages), previously filed as Exhibit A.
Francisco Esquembre, "Interrupted Pendulum" (Universidad de Murcia 2007), (six pages), previously filed as Exhibit B.
"Simple Harmonic Motion," dated Nov. 17, 1999, at http://physics.bu-edu/~duffy/py105/SHM.html (downloaded Dec. 14, 2012).

* cited by examiner

*Primary Examiner* — Sean Kayes
(74) *Attorney, Agent, or Firm* — Griffin & Szipl, P.C.

(57) ABSTRACT

The strike mechanism of a watch includes a gong secured by one end thereof to a gong-carrier integral with a plate, a hammer rotatably mounted on the plate for striking the gong at predetermined times, a damping counterspring for keeping the hammer at a distance from the gong in an idle mode, and a drive spring for driving the hammer. The drive spring includes one end secured to the plate and one end that is free to move. The spring is windable so that the free end of the drive spring drives the hammer against the gong in a strike mode to generate an acoustic sound. The strike mechanism further includes a stop member on the path of the hammer drive spring in the direction of the gong for increasing the rotational strike speed following contact of an intermediate part of the drive spring acting against the stop member.

13 Claims, 3 Drawing Sheets

STRIKE MECHANISM FOR A WATCH

This application claims priority from Swiss Patent Application No. 02002/09 filed Dec. 24, 2009, the entire disclosure of which is incorporated herein by reference.

FIELD OF THE INVENTION

The invention concerns a strike mechanism for a watch. The mechanism includes at least one hammer arranged for striking at least one gong, secured to a gong-carrier, at determined times. The hammer is held at a distance from the gong by a damping counterspring in an idle mode. A spring driving the hammer of the mechanism can be configured in the form of a resilient strip or beam. This drive spring can be wound to drive the hammer against the gong to provide an acoustic signal, for example, of a programmed time period.

BACKGROUND OF THE INVENTION

Within the field of watchmaking, a strike mechanism can be combined with a conventional timepiece movement to act as a minute repeater or to indicate a programmed alarm time. This type of strike mechanism generally includes at least one gong made of metallic material, such as steel, bronze, precious metal, metallic glass, sapphire or quartz. This gong may describe, for example, at least one portion of a circle around the timepiece movement in the watch frame. The gong is secured via at least one end thereof to a gong-carrier, which is itself integral with a watch plate. A hammer of the mechanism is rotatably mounted on the plate, for example in proximity to the gong-carrier, so as to strike the gong to make it vibrate. The sound produced when the hammer strikes the gong is within the audible frequency range from 1 kHz to 20 kHz. This indicates a well-defined time, programmed alarm or minute repeater to the person wearing the watch.

As shown in EP Patent No. 1 574 917, the strike mechanism of a watch may include two gongs secured via one end thereof to the same gong-carrier, which is itself integral with a plate. Each gong can be struck by a respective hammer. To achieve this, each hammer is driven by its own drive spring, which has to be pre-wound, so as to drive the hammer against the gong to indicate a minute repeater or alarm time. Two damping countersprings are provided for pushing back the hammers and holding them at a distance from the gongs in the idle mode. The damping countersprings also slow down the fall of each hammer prior to striking the respective gong before pushing each hammer back into the idle position. Eccentrics are also provided for regulating the operation of the countersprings to prevent each hammer bouncing against the respective gong.

One drawback of this type of strike mechanism structure with countersprings is that there is a significant waste of kinetic energy from the hammer when the respective gong is struck, which reduces the acoustic level of the strike work. Moreover, even if the pre-winding of the drive springs is increased, this means adapting the countersprings via their eccentric to prevent any bouncing, which is another drawback of this type of strike mechanism.

EP Patent No. 2 048 548, which mainly discloses a hammer for a watch strike mechanism, may also be cited. This hammer has two parts hinged to each other and a resilient element secured to one of the hinged parts. When the hammer is in a stable position, the resilient spring element holds the two parts of the hammer, whereas when the hammer is in the strike position, the two parts move away from each other, returned by the resilient spring element. With this arrangement, it is possible to reduce the kinetic energy wasted by the hammer against a damping member. However, in order to be able to prevent the hammer wasting energy when it strikes the gong, this hammer arrangement makes the strike mechanism more complicated to make, which is a drawback. The hammer may bounce against the gong in an undesirable manner during striking, which is another drawback.

SUMMARY OF THE INVENTION

It is thus an object of the invention to overcome the drawbacks of the aforementioned prior art by providing a strike mechanism for a watch, which includes means for increasing the acoustic level of the sound produced by at least one gong struck by at least one hammer, while preventing any bouncing and any waste of energy of the hammer during striking.

The invention, according to a first non-limiting illustrative embodiment, therefore concerns a strike mechanism for a watch, including: (a) a gong, which is connected to a gong-carrier, (b) a hammer, mounted on a plate for striking the gong at predetermined times, (c) a damping counterspring for keeping the hammer at a distance from the gong in an idle mode, and (d) a spring for driving the hammer, which includes a fixed end and an end that is free to move, wherein the drive spring is capable of being wound to drive the hammer against the gong in a strike mode to produce an acoustic sound, wherein the strike mechanism includes a stop member on the path of the drive spring of the hammer in the direction of the gong for increasing the rotational strike speed following contact of one part of the drive spring in action against the stop member. Particular additional embodiments of the strike mechanism for a watch are defined in the following second to thirteenth non-limiting illustrative embodiments of the present invention.

In accordance with a second non-limiting illustrative embodiment of the present invention, the first illustrative embodiment is further modified so that the free end of the spring is for driving the hammer against the gong in a strike mode, and wherein an intermediate part of the drive spring in action is for entering into contact with the stop member, to increase the strike speed of the hammer against the gong. In accordance with a third non-limiting illustrative embodiment of the present invention, the first illustrative embodiment is modified so that the drive spring is configured in the form of a beam or strip spring, so that an intermediate part of the pre-wound spring comes into contact with the stop member when the hammer strikes the gong. In accordance with a fourth non-limiting illustrative embodiment of the present invention, the fourth non-limiting embodiment is modified so that the strike mechanism includes an eccentric part mounted on the plate in contact with a surface of the counterspring for regulating the return force of the damping counterspring so as to push the hammer back after striking the gong and to keep the hammer at a certain distance from the gong in an idle mode. In accordance with a fifth non-limiting illustrative embodiment of the present invention, the fourth non-limiting embodiment is further modified so that the damping counterspring is a lever rotatably mounted along an axis of rotation on the bottom plate, and a first end of the lever is used to push back the hammer and to hold the hammer in an idle mode, and a second end of the lever on an opposite side to the first end relative to the axis of rotation is in contact with the eccentric part.

In accordance with a sixth non-limiting illustrative embodiment of the present invention, the first non-limiting embodiment is modified so that the hammer is rotatably mounted on the plate on an axis of rotation that is approximately perpendicular to the plane of the plate, and wherein the hammer includes a shaft, which is held in contact with a first end of the counterspring in an idle mode, and which is driven by the free end of the drive spring in action when the hammer strikes the gong. In accordance with a seventh non-limiting embodiment of the present invention, the first non-limiting embodiment is modified so that, in an idle mode, an intermediate part of the drive spring is in contact with a portion of the stop member, whereas the free end of the drive spring is at a distance from a shaft of the hammer, which is in contact with a first end of the counterspring. In accordance with an eighth non-limiting illustrative embodiment of the present invention, the first non-limiting embodiment is modified so that, in an idle mode, an intermediate part of the drive spring is in contact with a portion of the stop member, whereas the free end of the drive spring is in contact with a shaft of the hammer pushed by the first end of the counterspring. In accordance with a ninth non-limiting illustrative embodiment of the present invention, the first non-limiting embodiment of the present invention is modified so that it includes a lifting element rotatably mounted on the plate on an axis of rotation of the hammer, or on an axis of rotation parallel to the axis of rotation of the hammer, and the lifting element is provided for pushing a shaft of the hammer with the free end of the drive spring to place the spring in a pre-wound position at a distance from the stop member.

In accordance with a tenth non-limiting illustrative embodiment of the present invention, the first non-limiting embodiment is modified so that the stop member forms a lever, a free end of a first branch of which is provided for entering into contact with an intermediate part of the drive spring when the hammer strikes the gong. In accordance with an eleventh non-limiting illustrative embodiment of the present invention, the tenth illustrative embodiment is further modified so that an intermediate portion of the lever of the stop member is mounted on the axis of rotation of the counterspring, to form the base of the first branch of the stop member lever. In accordance with a twelfth non-limiting illustrative embodiment of the present invention, the eleventh illustrative embodiment is modified so that one end of a second branch of the stop member lever is connected to the counterspring via a second eccentric part for adjusting the position of the stop member on the counterspring. In accordance with a thirteenth non-limiting illustrative embodiment of the present invention, the twelfth non-limiting embodiment is further modified so that the damping counterspring includes a first end in contact with a shaft of the hammer for keeping the hammer in an idle position at a distance from the gong, and a second end of the rectilinear lever on an opposite side to the first end relative to the axis of rotation is in contact with a first eccentric part for adjusting the distance between an impact portion of the hammer and the gong in an idle position, and wherein the second eccentric part is rotatably mounted on the counterspring between the axis of rotation and the second end.

One advantage of the strike mechanism according to the present invention lies in the fact that at least one stop member is provided on the path of the hammer drive spring when the hammer strikes the gong. This generates a catapult effect of the hammer against the gong at the moment that an intermediate part of the hammer drive spring comes into contact with the stop member. To achieve this, the drive spring may take the form of a resilient metal strip or beam secured to the watch plate with one end free to push a catch or shaft of the rotating hammer when the hammer strikes the gong. The rotational speed of the end of the spring, which comes into contact with the hammer shaft to drive it against the gong, thus becomes greater after contact with the stop member, than the rotational speed of the end of the spring prior to contact with the stop member, which generates the catapult effect. There is thus less wasted energy from the hammer prior to striking the gong yet there is an increase in the acoustic level generated by the struck gong.

Another advantage of the strike mechanism lies in the fact that the hammer drive spring can be pre-wound further. This may be achieved without adapting the damping counterspring due to the presence of the stop member on the path of the hammer drive spring when the hammer strikes the gong. The stop member may be connected to the damping counterspring to activate the counterspring with a certain delay compared to the braking of the drive spring upon contact with the stop member. This also makes it easier to move the hammer away after striking the gong to prevent any bouncing.

BRIEF DESCRIPTION OF THE DRAWINGS

The objects, advantages and features of the watch strike mechanism will appear more clearly in the following description, made with reference to the annexed drawings, in which.

DETAILED DESCRIPTION OF THE INVENTION

In the following description, all those parts of the watch strike mechanism combined with the watch movement that are well known in this technical field will be only briefly described. The emphasis is mainly on the arrangement of the spring elements, including the stop member of the strike mechanism. This stop member guarantees an increase in the strike speed of the hammer with less hammer energy waste, and improved security against any hammer bounce against the gong.

Figure 1:
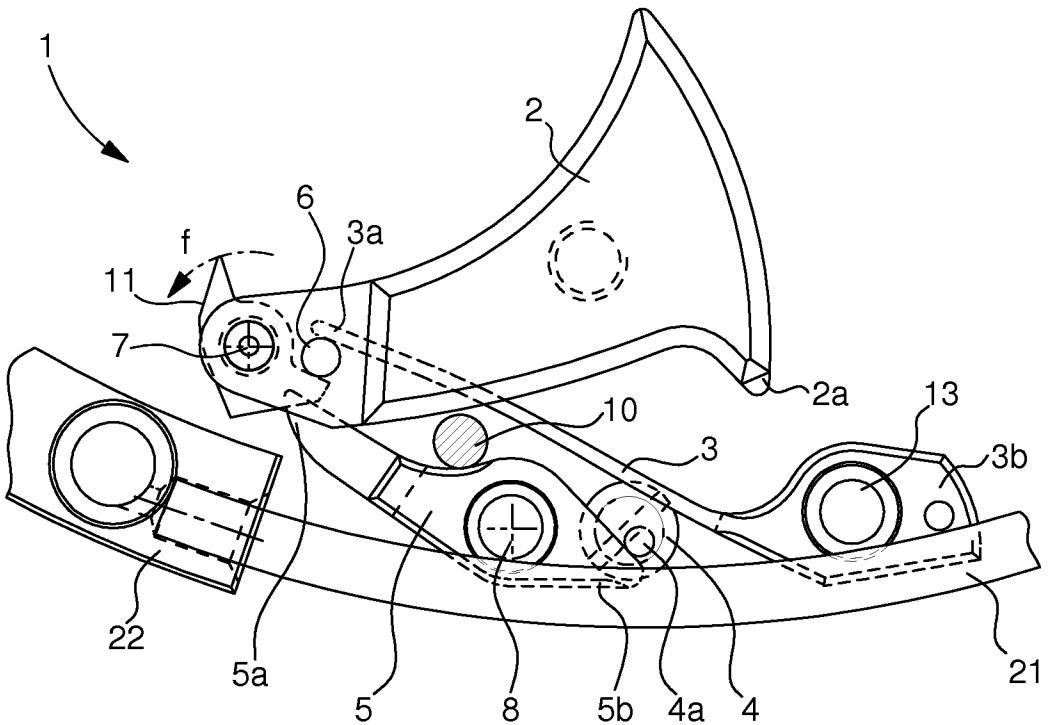
FIG. 1 shows a simplified plan view of a watch strike mechanism according to the invention with the drive spring pre-wound before the hammer strikes the gong.
Figure 2:
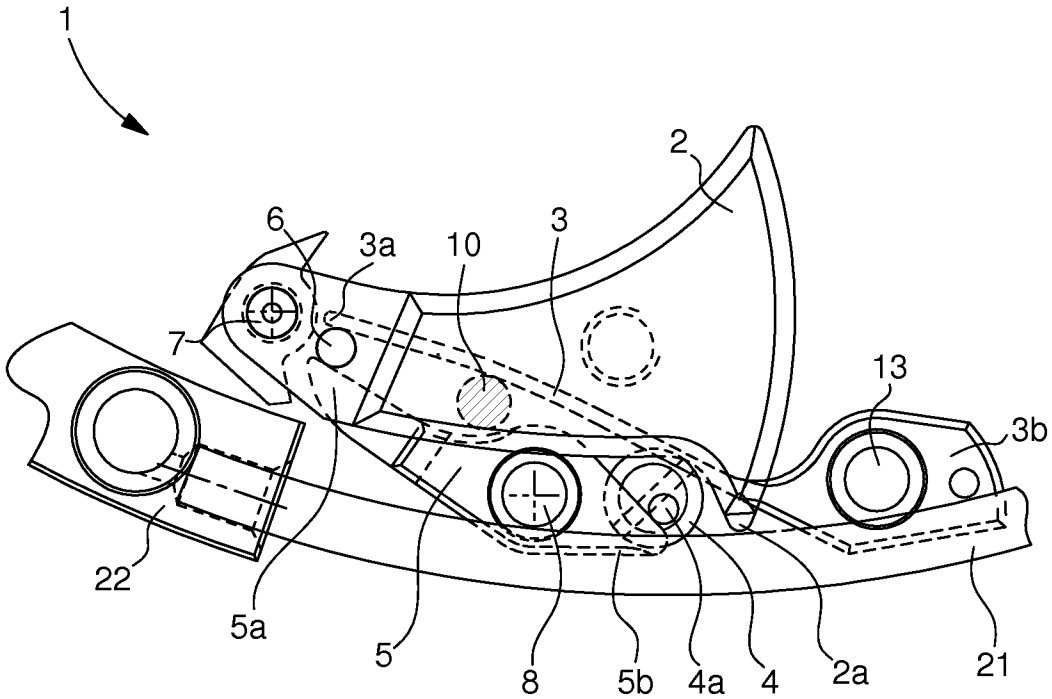
FIG. 2 shows a simplified plan view of a watch strike mechanism according to the invention when the hammer strikes the gong.

FIGS. 1 and 2 show a simplified view of a watch strike mechanism 1, whose various parts are mounted in a normal way on a plate, which is not shown to avoid overloading the Figures. This strike mechanism 1 includes at least one gong 21, which is secured at one end thereof to a gong-carrier 22, integral with the watch plate that is not shown. The other end of gong 21, not shown in FIGS. 1 and 2, is generally free to move. Gong 21 may be made in the form of at least one portion of a circle or rectangle. The gong may be, for example, a metal wire of circular or rectangular transverse section, generally made of steel or precious metal or metallic glass or another material. Conventionally, this portion of a circle or rectangle surrounds one part of the watch movement (not shown).

Strike mechanism 1 includes at least one hammer 2 rotatably mounted around an arbour 7 on the plate, in particular in proximity to gong-carrier 22. Strike mechanism 1 further includes a damping counterspring 5 for keeping hammer 2 at a distance from gong 21 in an idle mode, and a spring 3 for driving the hammer. This drive spring 3 may be wound to drive hammer 2 against the gong in a strike mode to produce an acoustic sound.

In FIG. 1, this drive spring 3 is pre-wound in an initial position via a lifting element 11, which is rotatably mounted on the axis of rotation 7 of hammer 2. Generally, lifting element 11 also drives a shaft 6 of hammer 2 in direction f, which pushes the free end 3*a* of drive spring 3 towards its pre-wound position at the start of the strike mode. In FIG. 2, however, drive spring 3 is shown in action in contact with shaft 6 of hammer 2 striking gong 21. Hammer drive spring 3 generally takes the form of a metal strip or beam, which is secured at one end 3*b*, for example by means of a screw 13, to the watch plate. The other free end 3*a* of drive spring 3 can therefore come into contact with shaft 6 of hammer 2 particularly in the strike mode to drive it in the direction of the gong 21 to be struck. Thus hammer 2, which has an impact portion 2*a* in the form of an edge, can be activated by the initially pre-wound drive spring 3 to strike gong 21 so as to indicate, for example, the hours, minutes or a programmed alarm time.

According to the invention, strike mechanism 1 also includes a stop member 10 on the path of drive spring 3 of hammer 2. This stop member 10 is only shown symbolically in FIGS. 1 and 2 in the form of a pin shown in hatched cross-section, which is held in a fixed position perpendicularly above the plate. It forms a point of contact of an intermediate part of drive spring 3 when it moves to drive hammer 2 against gong 21 via shaft 6 in a strike mode as shown in FIG. 2. The intermediate part of pre-wound drive spring 3 may preferably be arranged to come into contact with stop member 10, preferably before hammer shaft 6 driven by free end 3*a* of the spring comes into contact with damping counterspring 5, so as to generate a proper catapult effect of the hammer against the gong.

However, it is also possible to envisage hammer shaft 6 being held against counterspring 5, and the intermediate part of spring 3 coming back into contact with stop member 10 before the free end 3*a* of the spring comes into contact with the shaft 6 of hammer 2 to be driven against gong 21. As soon as the intermediate part of spring 3 enters into contact with stop member 10, the rotational speed of end 3*a* of active drive spring 3 is observed to increase compared to the rotational speed that precedes contact with stop member 10, which produces the catapult effect. This also prevents any significant loss of kinetic energy when the hammer strikes the gong.

After an idle mode, drive spring 3 is pre-wound at the start of the strike mode as shown partly in FIG. 1. The impact portion 2*a* of hammer 2, which ends in the form of an edge, is moved away from the gong particularly when it also drives spring 3 towards its pre-wound position. However, if shaft 6 of hammer 2 remains in contact with counterspring 5 as in the idle mode and just before the action of drive spring 3, this impact portion 2*a* is kept at a certain distance from the gong.

Counterspring 5 is formed in a known manner by a lever or pivoting part, which is rotatably mounted around an arbour 8 secured to the watch plate. A first end 5*a* of the lever of counterspring 5 abuts against shaft 6 of hammer 2 to hold it at a distance from gong 21. This first end 5*a* of metal counterspring 5 bends in the strike mode against the force applied by the drive spring 3 in action. After the hammer has struck gong 21, the first end 5*a* of the lever pushes hammer 2 back towards its idle position. A second end 5*b* of the lever in the form of a cam is arranged on an opposite side of first end 5*a* relative to axis of rotation 8. This second end 5*b* is in contact with an eccentric part 4 rotatably mounted on the plate. This eccentric part 4 includes a regulating wheel, on which an off-centre pin 4*a* is placed. Pin 4*a* is in direct contact with one surface of second end 5*b* of the lever in the form of a cam. By rotating eccentric part 4 on the plate, the operation of damping counterspring 5 can be adjusted, particularly to move the impact portion 2*a* of hammer 2 away from or closer to gong 21 in an idle mode.

The position of stop member 10 can also be adjusted relative to the beam or strip of drive spring 3. Stop member 10 can be moved in a direction along the metal strip or beam of drive spring 3. This allows the location of the point or line of contact of the intermediate part of drive spring 3 in action against stop member 10 to be altered in strike mode. Thus, the strike speed of hammer 2 may increase more or less sharply after spring 3 comes into contact against stop member 10. Stop member 10 may also be moved in the plane of gong 21 in a perpendicular direction to the gong so that drive spring 3 in action enters into contact with stop member 10 more or less quickly. A combination of adjustment between stop member 10 and counterspring 5 may also be envisaged.

Owing to the use of a stop member 10 on the path of spring 3 for driving hammer 2 against gong 21, spring 3 can easily be pre-wound to a greater or lesser extent without having to adjust damping counterspring 5 to prevent any bounce. Thus an absolute increase in the strike energy of the hammer against the gong can be obtained to increase the acoustic level without any effect on counterspring 5.

It is also to be noted that hammer 2 and gong 21 secured to gong-carrier 22 can preferably be fixed on a side of the plate opposite to the side that carries damping counterspring 5, drive spring 3 and stop member 10. In these conditions, counterspring 5, drive spring 3 and stop member 10 can easily be changed without any contact with the other parts on an opposite side of the plate. However, for the sake of simplification, in FIGS. 1 and 2 the various parts of strike mechanism 1 are arranged on the same side of the plate, which means that they can be clearly seen in this embodiment. The strike mechanism is thus shown in FIGS. 1 and 2 in a plan view from above.

To further improve the sound quality of gong 21 struck by hammer 2, the hammer can be made of a hard material, such as cobalt tungsten carbide (WCCo) or a ceramic material or diamond. At least the impact portion 2*a* of hammer 2 against gong 21 should be made of hard material. Moreover, the material of the hammer 2 may also have significant density to increase the energy when the hammer strikes the gong at a given strike speed of the hammer. Counterspring 5 may also be made of hard metal or steel, like stop member 10, whereas drive spring 3 can be made of conventional spring steel.

It is to be noted in a variant of the strike mechanism shown in FIGS. 1 and 2, that stop member 10 can be moved in line with drive spring 3 towards the free end 3*a* thereof. In these conditions, free end 3*a* of the spring in action enters into contact with the stop member before the spring bends and an intermediate part of spring 3 pushes hammer shaft 6 in the direction of gong 21. The increase in the hammer strike speed due to the stop member is also achieved with this configuration, which is not shown.

Figure 3:
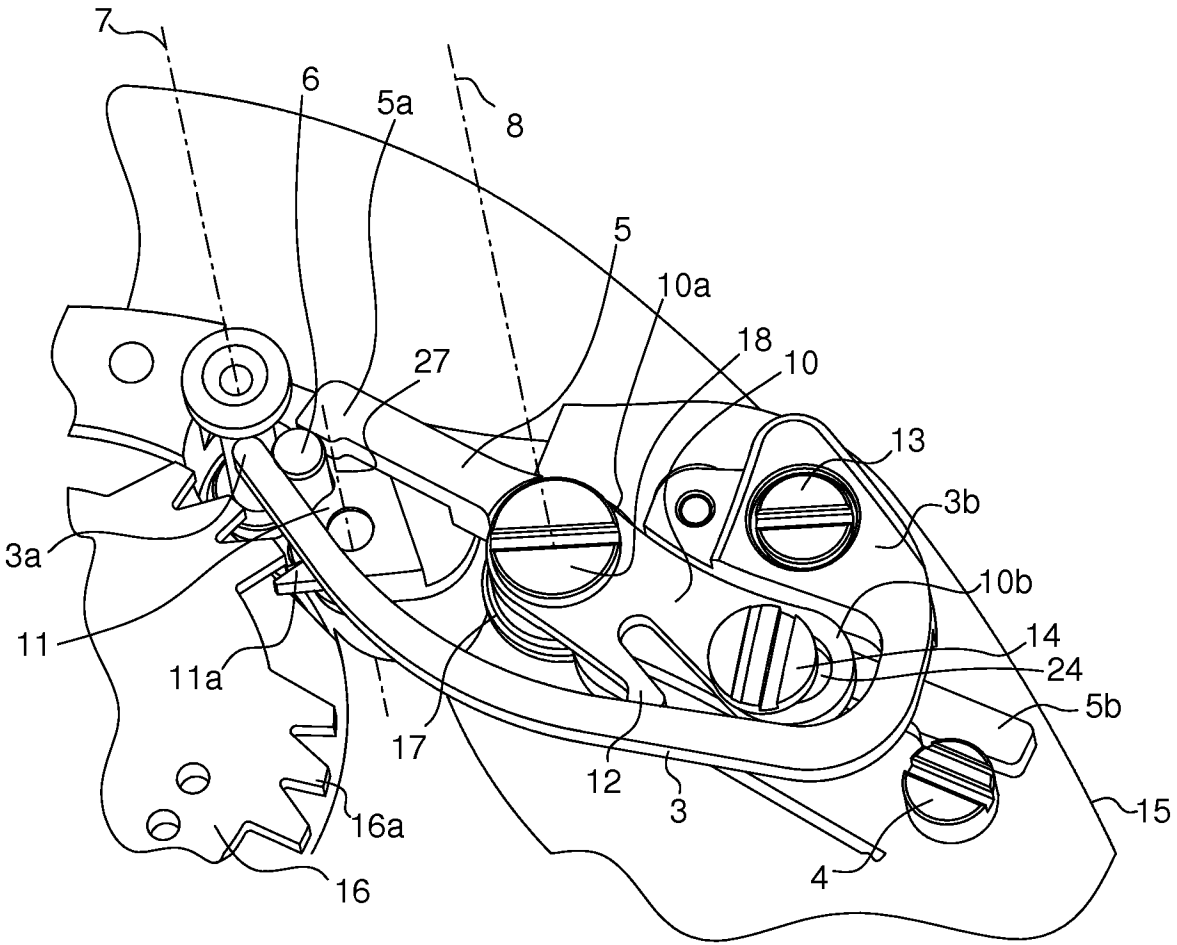
FIG. 3 shows a more detailed three-dimensional view of an arrangement of the spring elements of the strike mechanism according to the invention in an idle mode.

FIG. 3 shows another more detailed embodiment of the spring elements of strike mechanism 1 according to the invention, which are arranged on a side of the plate opposite to the side carrying the hammer and the gong secured to the gong-carrier. It is to be noted that those parts of FIG. 3 that match those of FIGS. 1 and 2 bear identical reference signs.

As FIG. 3 shows, hammer drive spring 3 is secured at one heel-shaped end 3*b* thereof, to the watch plate 15 via a screw 13. From this heel 3*b*, drive spring 3 has a metal strip or beam, which describes a U shape. This beam 3 surrounds stop member 10, which is shown in this embodiment in the form of a lever, one branch 12 of which has a free end that will come into contact with an intermediate part of the beam of drive spring 3. The contact of first lever branch 12 with the intermediate part of spring 3 may occur, for example, in a portion that corresponds to half the length of the beam from the end 3*b* thereof secured to plate 15. Free end 3*a* of the beam of drive spring 3 may be arranged in an idle mode at a slight distance from hammer shaft 6 (not shown). However, since stop member 10 is combined with counterspring 5, the first end 5*a* of the counterspring is driven with hammer shaft 6 by stop member 10 against the free end of the drive spring in the idle mode. The hammer is, however, held at a distance from the gong by damping counterspring 5 abutting against hammer shaft 6, which projects from plate 15 on the side of the spring elements.

Counterspring 5 is formed, as in the first embodiment of FIGS. 1 and 2, by an approximately rectilinear lever, rotatably mounted about an axis 8 perpendicular to watch plate 15. A first end 5*a* of this lever of counterspring 5 thus abuts against hammer shaft 6 to keep it at a distance from the gong in idle mode. The first end 5*a* of metal counterspring 5 can bend in the strike mode via the force applied by active drive spring 3, before pushing the hammer towards its idle position after the strike. A second end 5*b* of the lever is arranged on an opposite side to the first end 5*a* relative to axis of rotation 8. For the operation of returning the hammer to its idle position, this second end 5*b* is in contact with an eccentric part 4 rotatably mounted on plate 15 and used as a rotational stop member for counterspring 5.

Unlike the eccentric part shown in FIGS. 1 and 2, this eccentric part 4 is formed of a wheel in contact with one surface of the second end 5*b* so as to maintain the contact between hammer shaft 6 and the first end 5*a* of counterspring 5. This wheel of eccentric part 4 is mounted off-centre on a rotational pin arranged in a bore in the plate. By rotating this eccentric part 4, counterspring 5 can thus be adjusted to move the hammer further away from or closer to the gong in idle mode or particularly when the drive spring is pre-wound.

Stop member 10 in this embodiment is mounted on the axis of rotation 8 of counterspring 5. A screw foot 17, which includes a disc at the base thereof fixed to plate 15 and on the disc, a tubular part, which is smooth on the outside and threaded on the inside, is provided for mounting stop member 10 and counterspring 5 on plate 15. Counterspring 5, in the form of a lever, is first of all mounted on screw foot 17 to rest on the disc of the screw foot. To achieve this, counterspring 5 includes a through aperture in proximity to axis of rotation 8, whose diameter is equivalent to the external perimeter of the tubular part, enabling it to be assembled on the tubular part with no play. Stop member 10 further includes a through aperture in an intermediate portion 10*a*. The diameter of this aperture in the stop member is equivalent to the external perimeter of the tubular part of screw foot 17 for mounting the stop member without any play on the tubular part above counterspring 5. Once counterspring 5 and stop member 10 are arranged on the tubular part of screw foot 17, a screw 18 is screwed into the threaded portion of the tubular part. This screw 18 is screwed in as far as the mouth of the tubular part, which slightly projects from the aperture in stop member 10, positioned for keeping counterspring 5 and stop member 10 free to rotate on the plate.

A second eccentric part 14 can also be provided, rotatably mounted on counterspring 5, for adjusting the position of stop member 10 on counterspring 5. This eccentric part 14 includes a pin inserted in a bore of equivalent diameter made in an intermediate portion of counterspring 5 between axis of rotation 8 and the second end 5*b* of the counterspring. Above the pin, the second eccentric part 14 has an off-centre portion placed in another through aperture 24 with a particular shape at one end 10*b* of a second branch of stop member 10. In a known manner, this off-centre portion is in contact with an inner surface of the other transverse aperture 24 in the stop member. When the second eccentric part 14 is rotated, this enables the free end of the first lever branch 12 of stop member 10 to be moved closer to or further from the gong. In these conditions, the intermediate part of pre-wound drive spring 3 returns more or less quickly into contact with the free end of first lever branch 12 of stop member 10 when the hammer strikes the gong.

In this embodiment, the first and second lever branches of stop member 10 are arranged approximately opposite each other with a pierced portion between the two branches. The rotation of the free end of first branch 12 and the second branch occurs on the same side relative to axis of rotation 8 of stop member 10 and counterspring 5. On the path of drive spring 3 when the hammer strikes the gong, the intermediate part of the spring comes into contact first of all with the free end of first lever branch 12 of stop member 10. The second lever branch of stop member 10 is designed normally for driving counterspring 5 such that the first end 5*a* thereof comes into contact with hammer shaft 6 in the idle mode. In these conditions, the counterspring does not apply any return force against hammer shaft 6 given also that the second end 5*b* thereof is not in contact with the first eccentric part 4. The hammer strike speed is, however, increased as soon as the stop member acts against the intermediate part of active drive spring 3. This may occur in particular when the second end 5*b* of the counterspring comes into contact with the first eccentric part 4.

The second lever branch 12 of stop member 10 can also brake active drive spring 3 while generating the desired catapult effect of the hammer against the gong. In this operation for braking stop member 10, which is combined with counterspring 5, counterspring 5 is activated with a certain delay without slowing down the hammer as it falls in the direction of the gong.

As indicated above, when strike mechanism 1 is in an idle mode, the free end 3*a* of drive spring 3 can be at a distance from the hammer shaft 6 held against the first end 5*a* of damping counterspring 5. However, the intermediate part of drive spring 3 is abutting against the free end of first lever branch 12 of stop member 10. However, according to this embodiment of FIG. 3, the free end 3*a* of drive spring 3 comes into contact both with the free end of first lever branch 12 and the hammer shaft 6 pushed by the first end 5*a* of counterspring 5. Of course, instead of a lever, stop member 10 can also simply have a projecting member. This projecting member can be made in the same part between the two through apertures of the stop member so as to come into contact with the intermediate part of drive spring 3.

As shown in FIG. 3, the operation of pre-winding drive spring 3 can be performed by means of hammer shaft 6, which is driven by a lifting element 11 rotatably mounted on an axis of rotation 27 on plate 15. According to another embodiment that is not shown, this lifting element 11 can also be mounted on the axis of rotation 7 of the hammer. In a known manner, this lifting element 11 has a tooth 11*a* activated by a toothed wheel 16 rotatably mounted on the plate. The teeth 16*a* of this wheel 16 are arranged in accordance with the desired strike repeater. Thus, lifting element 11 can be rotated by toothed wheel 16 in a strike mode to wind drive spring 3 by pushing hammer shaft 6 against the free end 3*a* of drive spring 3.

Depending upon the type of material forming the gong, an initial adjustment must be made by one or other of eccentric parts 4, 14 to prevent any bounce when the hammer strikes the gong. For a gold gong compared to a steel gong, the impact portion of the hammer can be arranged further away from the gong. However, because of stop member 10, drive spring 3 may be pre-wound to a greater or lesser extent with any type of gong material once the initial adjustment has been performed. As a result of this arrangement of the spring elements of strike mechanism 1, a catapult effect is obtained by the hammer against the gong with increased strike speed following contact of pre-wound active drive spring 3 with stop member 10. The acoustic level produced by the struck gong is thus increased.

In general, then, the strike mechanism (1) of a watch includes a gong (21), which is secured by one end thereof to a gong-carrier (22) integral with a plate, a hammer (2) rotatably mounted on the plate for striking the gong (21) at predetermined times, a damping counterspring (5) for keeping the hammer at a distance from the gong (21) in an idle mode, and a drive spring (3) for driving the hammer. The drive spring includes one end (3*b*) secured to the plate and one end (3*a*) that is free to move. The drive spring is capable of being wound so that the free end (3*a*) of the spring drives the hammer (2) against the gong (21) in a strike mode to generate an acoustic sound. The strike mechanism further includes a stop member (10) on the path of the hammer drive spring in the direction of the gong for increasing the rotational strike speed following contact of an intermediate part of the drive spring (3) in action against the stop member.

From the description that has just been given, those skilled in the art can devise several variants of the watch strike mechanism fitted with a stop member, without departing from the scope of the invention defined by the claims. Several gongs of different lengths can be provided, secured to or integral with the same gong-carrier on the plate. Each gong can be struck by a respective hammer, or each hammer can be driven by its own drive spring with contact with a respective stop member on the path of each drive spring.

What is claimed is:

1. A strike mechanism for a watch, the mechanism including:

(a) a gong that is connected to a gong-carrier;

(b) a hammer mounted on a plate for striking the gong at predetermined times;

(c) a damping counterspring disposed to keep the hammer at a distance from the gong in an idle mode;

(d) a drive spring disposed to drive the hammer, wherein the drive spring includes a fixed end and a second end that is free to move, and the drive spring is capable of winding to drive the hammer by a hammer shaft against the gong in a strike mode to produce an acoustic sound, and the second end is free to move rotatably about a first axis defined by the fixed end; and (e) a stop member located on a path of the drive spring of the hammer in a direction of the gong so that a rotational strike speed of the second end of the drive spring increases following contact of an intermediate part of the drive spring acting against the stop member prior to the hammer striking against the gong in the strike mode, wherein the stop member provides a point of contact for the intermediate part of the drive spring and the point of contact defines a second axis about which the second end of the drive spring rotates when the drive spring contacts the stop member in order to increase the rotational strike speed of the hammer against the gong.

2. The strike mechanism according to claim 1, wherein the drive spring is configured as a beam or strip spring so that the intermediate part of the drive spring when pre-wound comes into contact with the stop member when the hammer strikes the gong.

3. The strike mechanism according to claim 1, wherein the strike mechanism further includes:

(f) an eccentric part mounted on the plate in contact with a surface of the counterspring in order to regulate a return force of the damping counterspring so as to push the hammer back away from the gong after striking the gong and to keep the hammer at a certain distance from the gong in the idle mode.

4. The strike mechanism according to claim 3, wherein the damping counterspring comprises a lever rotatably mounted along an axis of rotation on the plate, wherein a first end of the lever is employed to push back the hammer away from the gong and to hold the hammer in the idle mode, and a second end of the lever on an opposite side to the first end relative to an axis of rotation is in contact with the eccentric part.

5. The strike mechanism according to claim 1, wherein the hammer is rotatably mounted on the plate on an axis of rotation that is approximately perpendicular to the plane of the plate, and wherein the hammer includes a shaft that is held in contact with a first end of the counterspring in the idle mode, and the shaft is driven by the second end of the drive spring in action when the hammer strikes the gong.

6. The strike mechanism according to claim 1, wherein, in the idle mode, the intermediate part of the drive spring is in contact with a portion of the stop member, and the second end of the drive spring is at a distance from a shaft of the hammer, and the shaft is in contact with a first end of the counterspring.

7. The strike mechanism according to claim 1, wherein, in the idle mode, the intermediate part of the drive spring is in contact with a portion of the stop member, and the second end of the drive spring is in contact with a shaft of the hammer that is pushed by a first end of the counterspring.

8. The strike mechanism according to claim 1, wherein the strike mechanism further includes:

(f) a lifting element rotatably mounted on the plate on an axis of rotation of the hammer, or on an axis of rotation parallel to the axis of rotation of the hammer, and the lifting element is disposed to push a shaft of the hammer with the second end of the drive spring to place the drive spring in a pre-wound position at a distance from the stop member.

9. The strike mechanism according to claim 1, wherein the stop member comprises a lever, wherein a free end of a first branch of the lever is provided for entering into contact with the intermediate part of the drive spring when the hammer strikes the gong.

10. The strike mechanism according to claim 9, wherein an intermediate portion of the lever of the stop member is mounted on an axis of rotation of the counterspring so as to form a base of the first branch of the lever of the stop member.

11. The strike mechanism according to claim 10, wherein one end of a second branch of the lever of the stop member is connected to the counterspring via a first eccentric part for adjusting a position of the stop member on the counterspring.

12. The strike mechanism according to claim 11, wherein the damping counterspring includes a first end in contact with a shaft of the hammer for keeping the hammer in an idle position at a distance from the gong, and a second end of a rectilinear lever on an opposite side to the first end relative to the axis of rotation of the counterspring is in contact with a second eccentric part for adjusting a distance between an impact portion of the hammer and the gong in the idle position, and wherein the first eccentric part is rotatably mounted on the counterspring between the axis of rotation and the second end.

13. A watch comprising a strike mechanism operably connected with a watch movement, wherein the strike mechanism includes:

(a) a gong that is connected to a gong-carrier;

(b) a hammer mounted on a plate of the watch for striking the gong at predetermined times;

(c) a damping counterspring disposed to keep the hammer at a distance from the gong in an idle mode;

(d) a drive spring disposed to drive the hammer, wherein the drive spring includes a fixed end and a second end that is free to move, and the drive spring is capable of winding to drive the hammer by a hammer shaft against the gong in a strike mode to produce an acoustic sound, and the second end is free to move rotatably about a first axis defined by the fixed end; and (e) a stop member located on a path of the drive spring of the hammer in a direction of the gong so that a rotational strike speed of the second end of the drive spring increases following contact of an intermediate part of the drive spring acting against the stop member prior to the hammer striking against the gong in the strike mode, wherein the stop member provides a point of contact for the intermediate part of the drive spring and the point of contact defines a second axis about which the second end of the drive spring rotates when the drive spring contacts the stop member in order to increase the rotational strike speed of the hammer against the gong.

* * * * *

UNITED STATES PATENT AND TRADEMARK OFFICE

CERTIFICATE OF CORRECTION

PATENT NO. : 8,514,669 B2
APPLICATION NO. : 12/976004
DATED : August 20, 2013
INVENTOR(S) : Sylvain Marechal et al.

It is certified that error appears in the above-identified patent and that said Letters Patent is hereby corrected as shown below:

On the Title page, in Item (75) Inventors, the first inventor's city should read -- Bois d'Amont (FR) --.

Signed and Sealed this
Fourth Day of March, 2014

Michelle K. Lee

Michelle K. Lee
*Deputy Director of the United States Patent and Trademark Office*